US005601518A

United States Patent [19]

Weintraub

[11] Patent Number: 5,601,518

[45] Date of Patent: Feb. 11, 1997

[54] PORTABLE EXERCISE DEVICE

[76] Inventor: Mitchell Weintraub, 1131 Arlanie Rd., Brooksville, Fla. 34609

[21] Appl. No.: 522,847

[22] Filed: Sep. 1, 1995

[51] Int. Cl.[6] ..... A63B 21/04

[52] U.S. Cl. ..... 482/129; 482/904

[58] Field of Search ..... 482/121, 122, 482/123, 129, 904, 100

[56] References Cited

U.S. PATENT DOCUMENTS

| | | | |
|---|---|---|---|
| 679,784 | 8/1901 | Ryan . | |
| 1,237,588 | 8/1917 | Vaughn | 482/129 |
| 2,938,695 | 5/1960 | Ciampa . | |
| 4,072,308 | 2/1978 | Applegate . | |
| 4,709,920 | 12/1987 | Schnell | 482/100 |
| 4,830,365 | 5/1989 | March . | |
| 5,050,869 | 9/1991 | Frate . | |

*Primary Examiner*—Lynne A. Reichard
*Attorney, Agent, or Firm*—C. Douglas McDonald & Associates, P.A.

[57] ABSTRACT

A portable exercise device that is usable in the home by attachment to supporting structure. The device comprises a pair of bases that are configured for attachment to a support, a member having a peripheral edge being pivotally attached to one of the bases and a bar being pivotally attached to the other base. One end of the bar is attached to the base to which the member is attached by a resistance mechanism. To the other end of the bar is attached a strap that engages a portion of the peripheral edge of the member and extends therefrom for attachment to a grip. This structure reduces the resistance force produced by the resistance mechanism as the exerciser approaches full contraction of the muscle group being exercised to ensure a completely full contraction is made. The device also compensates for the use of a non-linear resistance mechanism. In addition the resistance provided by the device is easily adjustable, providing the appropriate resistance for the particular muscle group being exercised.

7 Claims, 7 Drawing Sheets

PORTABLE EXERCISE DEVICE

FIELD OF THE INVENTION

The present invention relates exercisers, and more particularly to portable devices which may be mounted on a door to provide resistance training.

DESCRIPTION OF THE PRIOR ART

Exercising the muscles of the body to increase the strength and fitness of an individual by lifting free weights or by using a system of cables and pulleys to lift weights is well known in the art. It was found that free weights did not provide correct exercises for many muscle groups and the use of cables and pulleys with weights was cumbersome and created storage problems. The development of devices that used springs or elastic bands to provide the resistance to muscle contraction eliminated the problems inherent with handling heavy weights, but created new problems. Such devices include U.S. Pat. No. 679,784 and U.S. Pat. No. 689,418, both issued to M. B. Ryan, U.S. Pat. No. 4,072,308 issued to L. T. Applegate, and U.S. Pat. No. 5,050,869 issued to R. A. Frate. The exerciser's strength varies as the leverage varies across the joints through the various positions of muscle flexion; being relatively weak at full extension, at or near peak contractual capability at the mid-range position of flexion and weaker as complete contraction is approached. When the exerciser approaches full contraction and is working against the same or increased resistance, the exerciser is often incapable or frequently discouraged from making a thoroughly complete contraction. Failure to make a thoroughly complete contraction leads to improper muscle development. In addition many devices use non-linear elastic bands or springs so that the resistance does not remain constant but continues to increase, making it very difficult for the exerciser to make a thoroughly complete contraction. Larger, more bulky, non-portable, exercising apparatus are able to compensate for the reduced muscle strength as complete contraction is approached to ensure a complete contraction is obtained by the exerciser; however, the smaller, more portable exercise devices known today are unable to compensate for decreased muscle strength or non-linear resistance devices, so that users do not obtain proper muscle development.

The amount of resistance provided by exercise devices that use springs and elastic bands is not easily adjustable making it difficult to use varying exercises that require various resistance forces. The capability of easy adjustment and a relatively wide choice of resistance levels is important, as muscle groups have different strengths and must be worked against different resistance forces for proper training. Also, as the exerciser's strength increases, increased resistance is needed.

Therefore, not withstanding the existence of such prior art exercise apparatus, it remains clear that there is a need for a portable exercise device that utilizes the less bulky elastic bands or springs, is easily portable, provides a means for compensating for the changes in muscle strength as the exerciser moves through the positions of flexion, can compensate for the increased resistance as the band or spring stretches, and provides a means for easily adjusting the resistance.

SUMMARY OF THE INVENTION

The present invention relates to a portable exercise device that uses a biasing means to provide the opposing resistance force. The exercise device compensates for varying muscle strength as the exerciser moves through the positions of flexion during an exercise, and can compensate for the increased resistance that occurs as the biasing means is extended. The amount of resistance produced by the exercise device is easily adjustable. Most simply stated, the exercise device of this invention comprises a pair of bases that are spaced apart from one another and which are configured for attachment to a support means. A member having a peripheral edge is pivotally attached to one of the pair of bases. A bar, having first and second ends, is pivotally attached at a pivot point, that lies intermediate the first and second ends of the bar, to the other one of the pair of bases. The bar is comprised of two parts, a first part is defined as that portion of the bar that extends from the pivot point to and including the first end of the bar and a second part is defined as that portion of the bar that extends from the pivot point to and including the second end of the bar.

The first end of a longitudinally extending strap is attached to the first part of the bar, a portion of the strap engages a portion of the peripheral edge of the member, and the second end of the strap remains free. A longitudinally extending biasing means has a first end that is connected to the base to which the member is also attached, and a second end that is attached to the second part of the bar.

As will be described in greater detail below, as the second end of the strap is pulled, the member pivots so that the strap pulls on the first part of the bar rotating the bar about the pivot point. As the bar rotates about the pivot point, the biasing means stretches providing resistance to the rotation of the bar, and thus, resistance to movement of the second end of the strap. When the strap is released, the biasing means retracts and the member pivots toward its original position. By pulling on the strap, the exerciser's muscles are worked as the exerciser pulls against the resistance of the biasing means. By moving the point of attachment of the first end of the strap along the first part of the bar, the moment arm will be shortened, increasing resistance, as the point of attachment is moved toward the pivot point and lengthened, decreasing resistance, as the point of attachment is moved toward the first end of the bar. Moving the point of attachment of the second end of the biasing means from the second end of the bar toward the pivot point will shorten the moment arm, decreasing the resistance, while moving the point of attachment toward the second end of the bar will increase the moment arm, increasing the resistance.

Accordingly, the invention comprises an article of manufacture possessing the features, properties, and the relation of elements which will be exemplified in the article hereinafter described, and the scope of the invention will be indicated in the claims.

BRIEF DESCRIPTION OF THE DRAWINGS

For a full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 5:
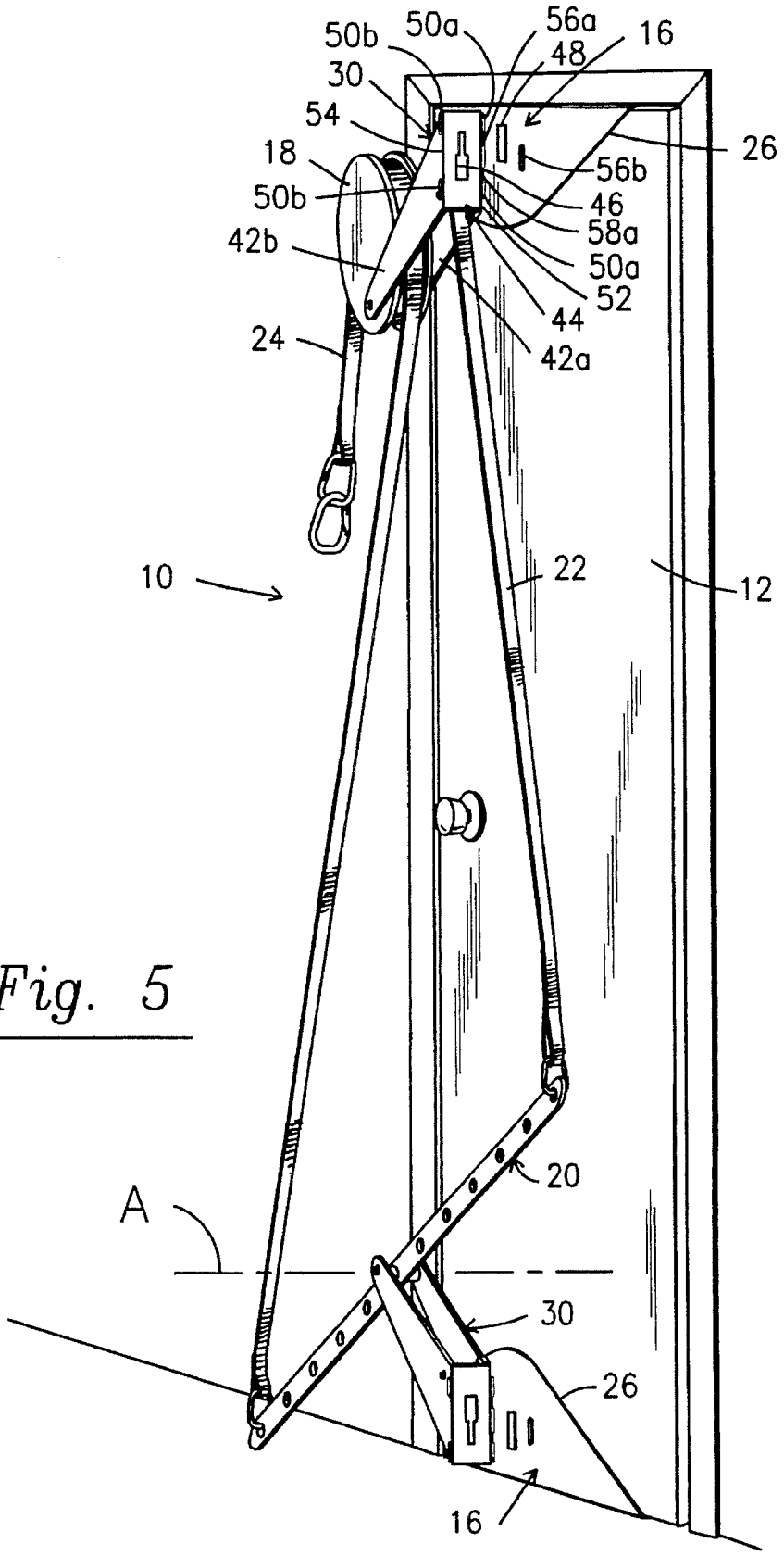
FIG. 5 is a perspective view of the invention of FIG. 1 illustrating the invention in a storage position.
Figure 6:
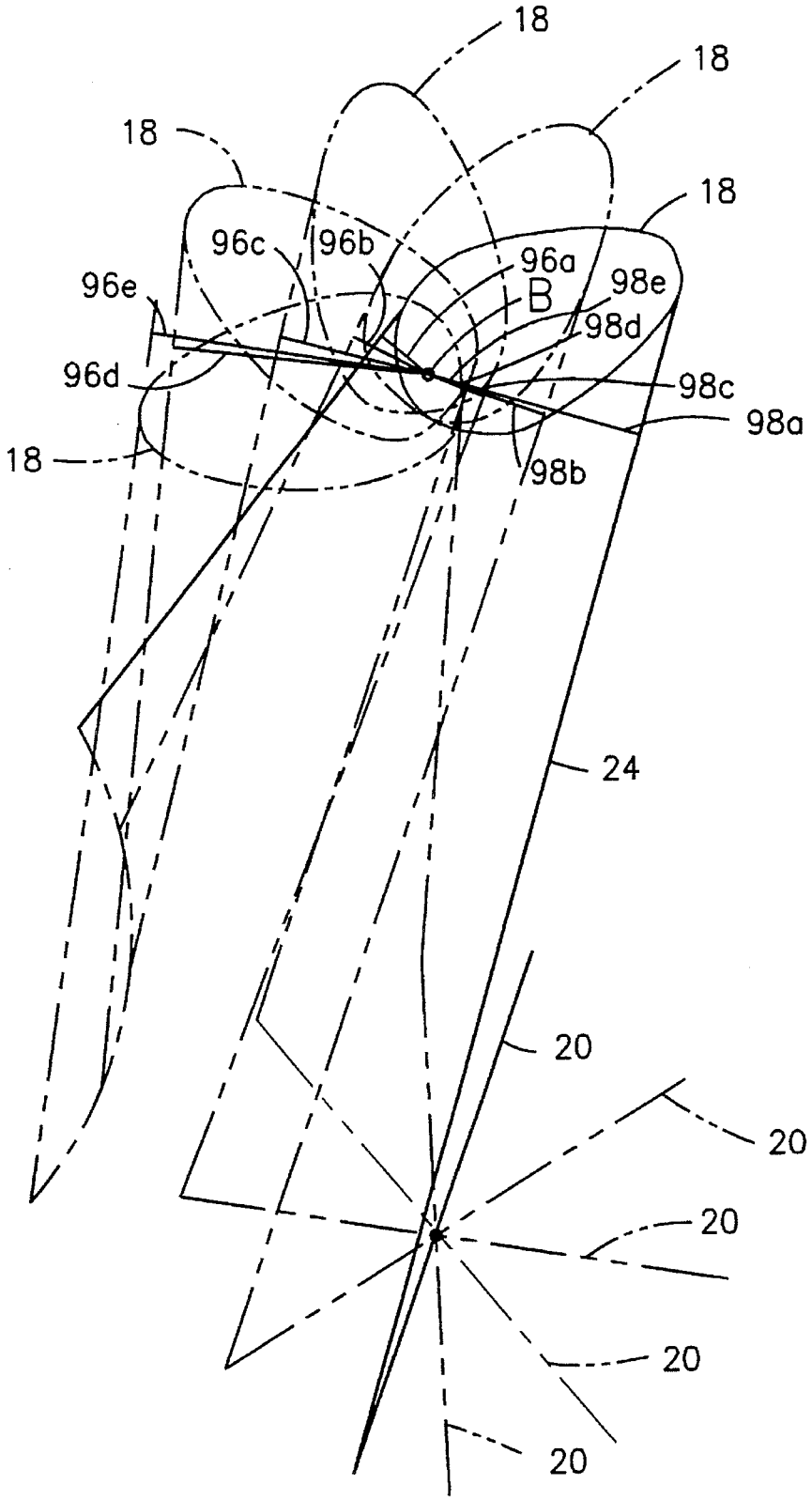
FIG. 6 is a graphical representation of the member of the invention as it pivots from the setup position to the fully extended position, illustrating the changes to the moment arms as the member pivots.
Figure 7:
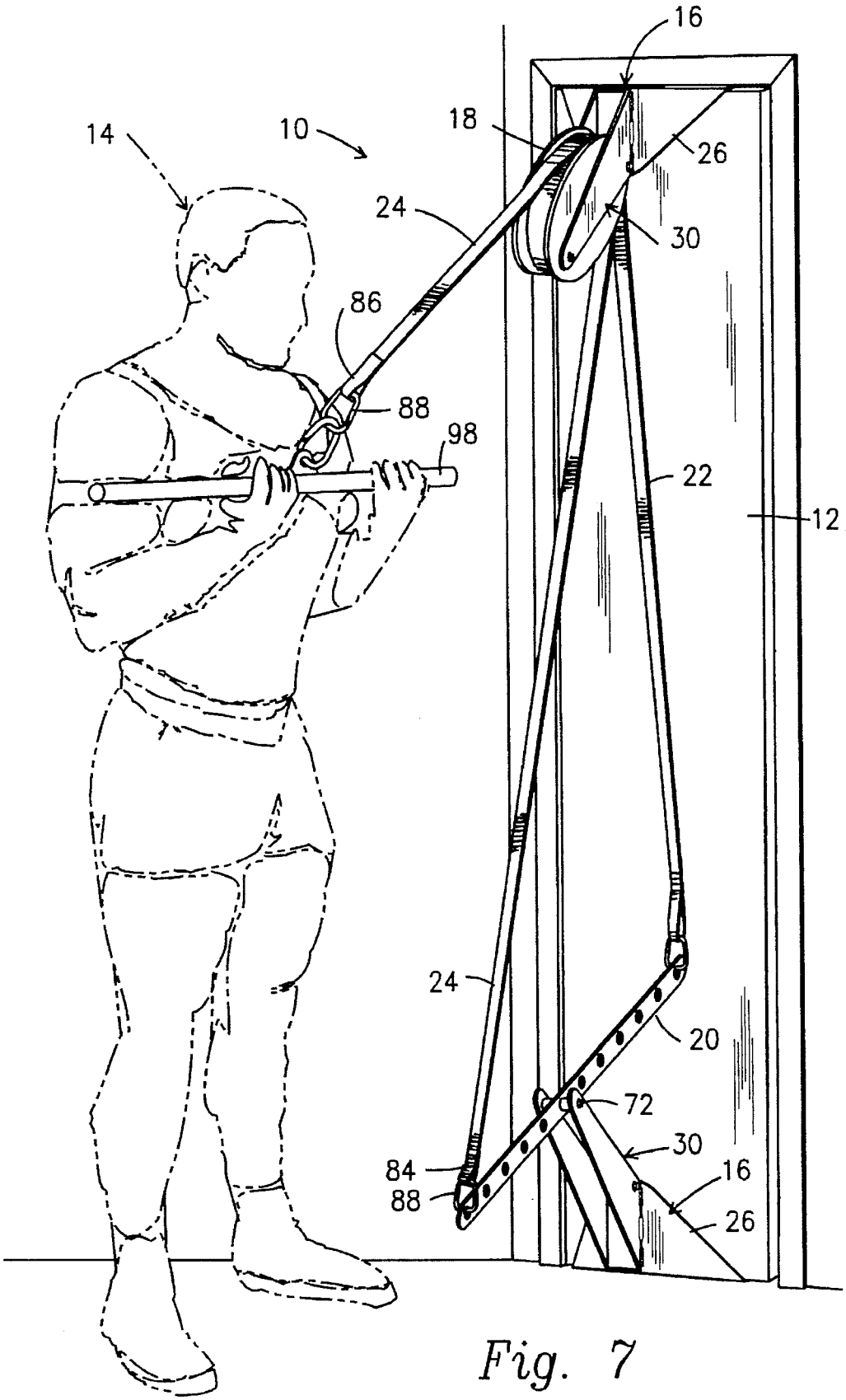
FIG. 7 is a perspective view of the invention of FIG. 1 illustrating the device in use.

A preferred embodiment for the exercise device of this invention is illustrated in the drawing FIGS. 1–7. The exercise device is generally indicated as 10 in the views of FIGS. 1–3, 5, and 7. The device is illustrated in FIGS. 1–6, and 7 being installed on a door 12. FIG. 7 illustrates an exerciser 14 shown in phantom operating the device 10 while it is installed on a door 12. Referring first to the view of FIG. 1, it can be seen that the exercise device 10 comprises a pair of bases, shown generally as 16, a member 18, a bar, shown generally as 20, a longitudinally extending biasing means 22, and a longitudinally extending strap 24.

Each base 16 is comprised of a plate 26, an L-shaped extension 28 extending therefrom, and an arm 30 that also extends outwardly from the plate 26. The L-shaped extension 28 has a first leg 32 and a second leg 34 that are joined to one another at generally right angles. The plate 26 has a first edge 36 to which the first leg 32 is attached so that it extends normally outwardly therefrom in a direction opposed to arm 30. The second leg 34 is spaced apart from the plate 26 so that the L-shaped extension 28 may receive a support means, conveniently a standard door 12 between the extension 28 and the plate 26, so that the first leg 32 fits snugly against the top edge of the door 12 or snugly against the bottom edge 40 of the door 12. In a preferred embodiment, the extension 28 and the plate 26 are integrally formed as a single unit. While in a preferred embodiment the bases are formed to be attached to a door, in other embodiments, the devices may be made with or without the extension 28 and attached to other support means, including but not limited to walls and floors.

Figure 1:
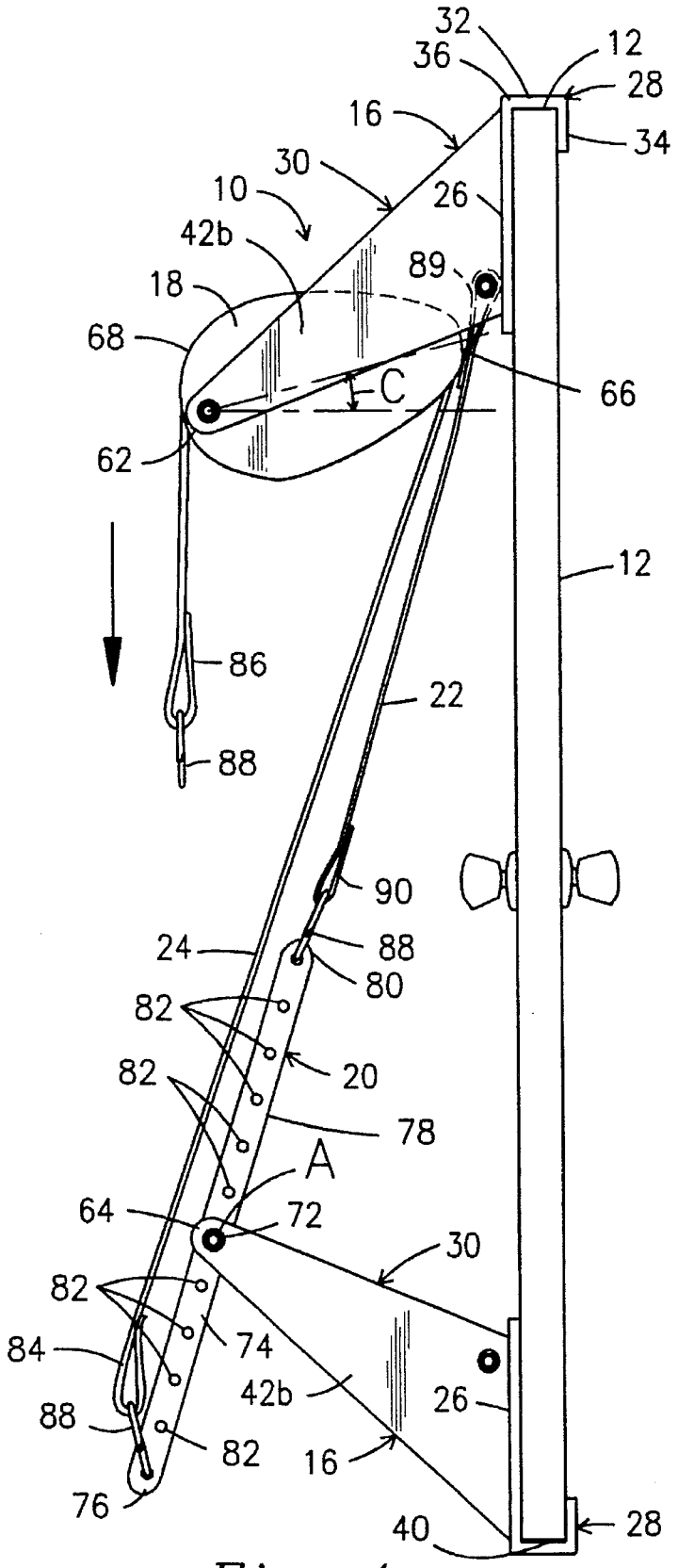
FIG. 1 is a right side elevation view of the invention illustrating attachment of the invention to a door and illustrating the initial setup position of the device.
Figure 3:
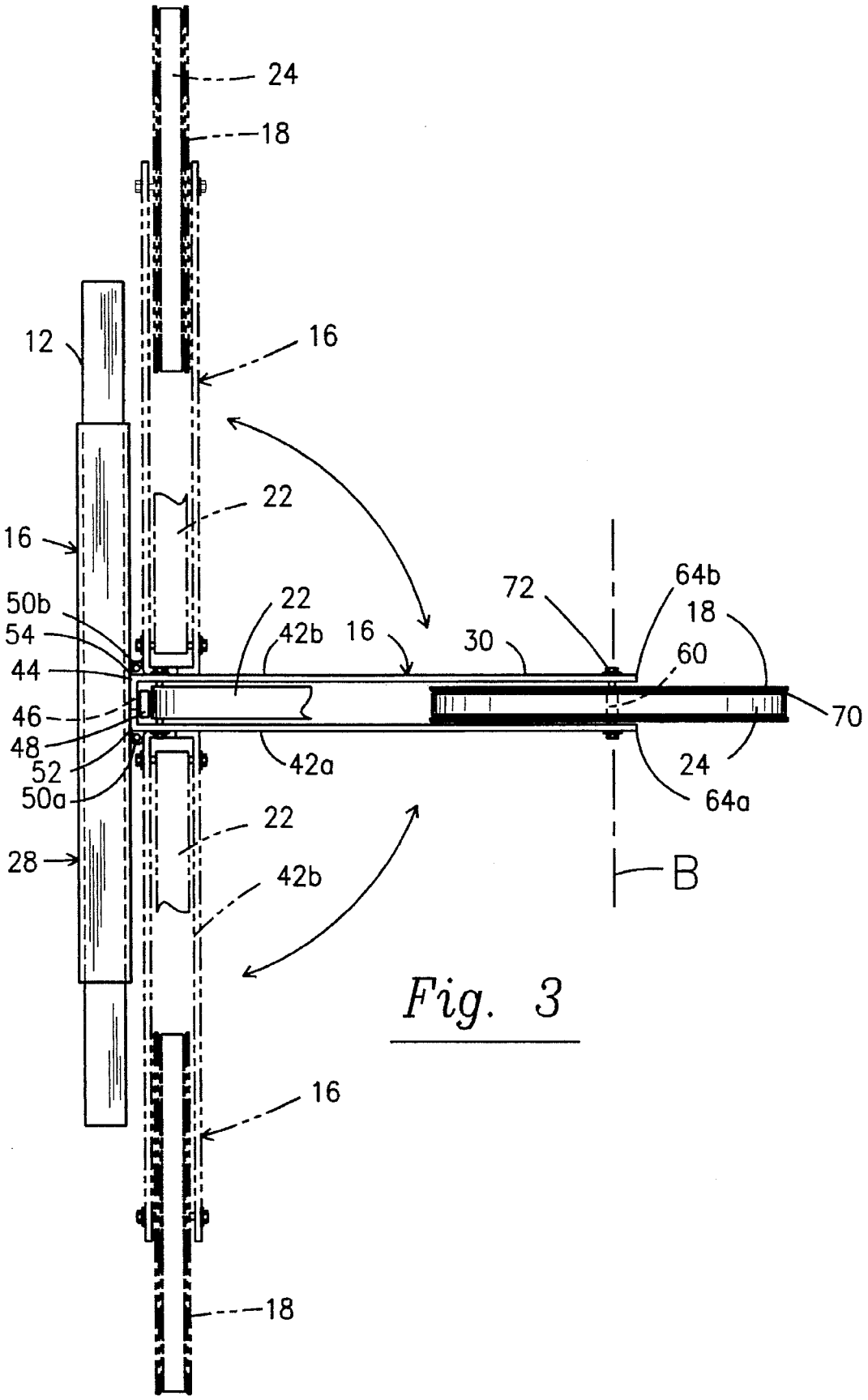
FIG. 3 is a top plan view of the invention of FIG. 1, illustrating in phantom the storage positions of the device while attached to a door, and illustrating the member rotated approximately 75 degrees from the setup position.

In a preferred embodiment, as shown in FIGS. 1 and 3, the arm 30 of each base 16 is a U-shaped member comprising a pair of struts 42 that are joined to one another by a web 44. As best seen in FIGS. 3 and 5, the arm 30 is removably attached to the plate 16. In other embodiments the arm 30 may be fixedly attached generally normal to the plate 16. In a preferred embodiment, the arm 30 has a key hole 46 formed in the web 44 and the base 16 has a T-shaped projection 48 that is attached to the plate 26. The T-shaped projection 48 is sized and configured to be received through the wide portion of the keyhole 46. By moving the arm 30 so that the projection 48 is received by the narrow section of the keyhole 46, the arm 30 becomes attached to the plate 26.

For storage purposes, each base 16 has a pair hinge journals 50(*a*) attached to the first end 52 of strut 42(*a*) and a second pair of hinge journals 50(*b*) are attached to the first end 54 of strut 42(*b*). Each hinge journal of each pair of hinge journals 50(*a*) and 50(*b*) are spaced apart from one another so that hinge journals 56 that are attached to the plate 16 may be received therebetween when the arm 30 is mounted to the plate 26. When the arm 30 is mounted on the plate 26, a hinge pin 58(*a*) may be inserted through the journals 50(*a*) and 56(*a*). Hinge journal 56(*a*) and hinge journals 50(*a*) are sized so that there is sufficient space between hinge journal 56(*a*) and hinge journals 50(*a*) that the keyhole 46 may be moved on the projection 48 while the arm 30 remains hingedly attached to plate 16. After the T-shaped projection 48 disengages from the large end of the keyhole 46 the arm 30 may hingedly pivot on hinge pin 58(*a*) moving the arm 30 to a storage position generally parallel to the door 12, as shown in FIG. 5. By inserting hinge pin 58 within journals 50(*b*) and journal 56(*b*), the arm 30 may be pivoted in the opposite direction for storage generally parallel to the door 12.

As seen in FIG. 3, member 18 has a hole 60 therethrough proximal to the first end 62 of the member 18. The member 18 is pivotally mounted between the second ends 64(*a*) and 64(*b*) of the struts 42(*a*) and 42(*b*) of one of the pair of bases 16, defining an axis B. In a preferred embodiment illustrated in FIGS. 1–3, it can be seen that the member 18 is generally flat and elongated from the first end 62 to a second end 66 and has a peripheral edge 68. The peripheral edge 68 has a recess 70 formed therein as seen in FIG. 3. As seen in FIG. 1, the peripheral edge 68 of member 18 defines an ovoid shape, where the member is egg shaped with one end of the member larger than the other. In other embodiments, member 18 may define other shapes, which will be discussed more fully below.

A bar 20 is pivotally mounted to the other one of the pair of bases 16, the one to which member 18 is not attached. The bar 20 is mounted between the struts 42 proximal to the second ends 64 thereof. A bolt 72 inserted through holes (not shown) through the second ends 64 of the struts 42 defines a pivot point A about which bar 20 pivots. The bar 20 comprises two parts, the portion of the bar 20 extending from the pivot point A to and including the first end 76 of the bar 20 defining the first part 74 and the portion of the bar 20 extending from the pivot point A to the second end 80 of the bar 20 defining the second part 78. Bar 20 also comprises a plurality of attaching means, conveniently apertures 82.

Figure 4:
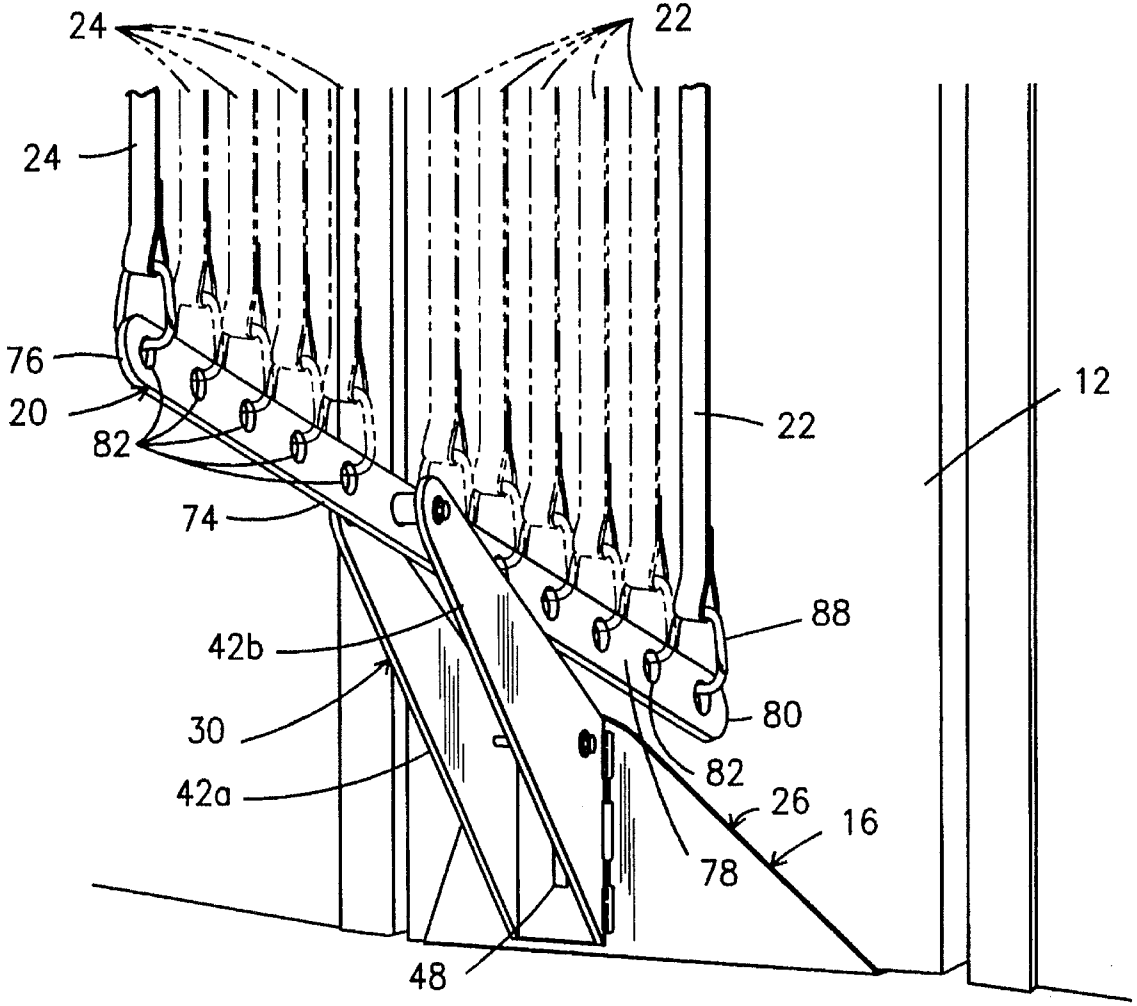
FIG. 4 is a detailed view of the bar of the invention illustrating the various attachment points.

The strap 24 has a first end 84 which is attached to the first part 74 of bar 20. A portion of the strap 24 engages the peripheral edge 68 of member 18 and the second end 86 of the strap 24 extends free from the member 18. The strap 24 may be attached to the member 18 by screws 92 and a clamp 94 though which the screws extend into and are received by member 18 within the recess 70, holding the strap within the recess 70 while the member 18 pivots. As seen in FIG. 4, the first end 84 of the strap 24, in a preferred embodiment may be attached by a linking means 88 to any one of the apertures 82 formed in the first part 74 of the bar 20.

A longitudinally extending biasing means 22 has a first end 89 that is attached to the base 16 to which the member 18 is attached, and the second end 90 of the biasing means 22 is attached to the second part 78 of the bar 20. As seen in FIG. 4, the second end 90 of the biasing means 22 may be attached by a linking means 88 through any one of the plurality of apertures 82 formed in the second part 78 of the bar 20. The linking means 88, in the embodiment illustrated, is a snap link that may be clipped through the holes 82. Of course, in other embodiments, the linking means 88 and the attaching means 82 may be comprised of any well known methods for attaching a strap to a bar, including means which may slide upon the bar 20 and be clamped thereto.

Figure 2:
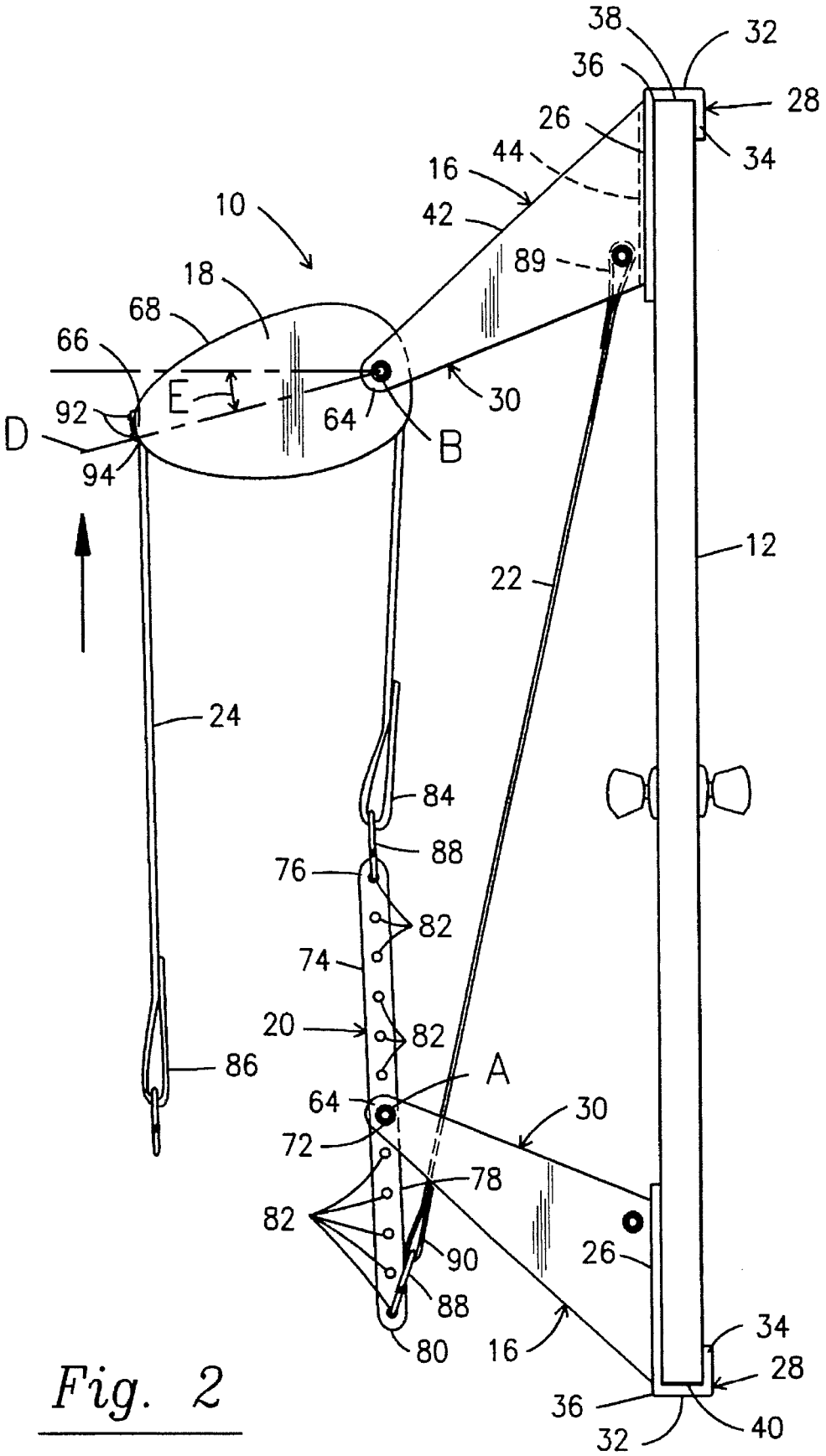
FIG. 2 is the apparatus of the invention of FIG. 1 illustrating the invention in the fully extended position.

FIG. 1 illustrates the setup position, the position before tension is taken on strap 24 by the exerciser 14. It will be noted that in this preferred embodiment in the setup position, the angle C is approximately 15°, that is a longitudinal reference line D extending from the first end 62 to the second 66 of member 18 is approximately 15° from horizontal. In the fully extended position, when strap 24 is fully extended, as seen in FIG. 2, the angle E is approximately 15°, that is the longitudinal reference line D is approximately 15° below the horizontal.

It can be seen in FIG. 6 that as member 18 pivots about its axis B in the counter-clockwise direction, as viewed in FIG. 5, the moment arm 96 increases in length from the setup position where the moment arm 96(*a*) is short to 96(*d*) where the moment arm is longer. It can also be seen that an opposing (negative) moment arm 98 generated on the opposite side of member 18, between strap 24 and axis B is relatively large in the set up position at 98(*a*) to a small moment arm at 98(*d*). Therefore, initially, the exerciser 14 is working against moment arm 98(*a*) minus moment arm 96(*a*), and in the fully contracted position, the exerciser is assisted by moment arm 96(*d*) minus moment arm 98(*d*). The decreasing negative moment arm 98 and the increasing positive moment arm 96 compensates for the increasing weakness of the muscles being exercised as they approach full contraction. At the setup position, when the muscles are at full extension and are weaker, the biasing means 22 has not reached its full resistance (including those biasing means that are described as linear) and the resistance force is considerably weaker; therefore, the longer negative moment arm provides additional resistance to overcome a portion of the reduced resistance in the biasing means 22. By overcoming only a portion of the reduced resistance, the resistance is less than at mid-extension of the biasing means 22 to assist the exerciser 14 when the muscles are at full extension. For non-linear biasing means, the exercise device 10 compensates for the increased resistance that is developed by the biasing means 22 as it is stretched so that the force applied by the exerciser 14 may be relatively constant and is reduced as the exerciser reaches the point of a thoroughly complete contraction.

Preferably, the member 18 is sized so that when the second end 86 of strap 24 is fully extended the second end 86 completes at least 32 inches of travel, to provide the full range of motion necessary for different exercises. In a preferred embodiment, the member is approximately 21 inches from end to end, 17 inches wide, and the pivot point B is 2½ inches from the first end 62. The curvature of the large end is created by a 180° arc with a radius of 8 inches about a point that lies along the centerline D extending between the first end 62 and the second 66 and lies approximately 8 inches from the first end 62. The curvature for the second end 66 is created by a 90 degree arc with a radius of approximately 4.7 inches about a point 4.7 inches along the centerline D from end 66. The sides of member 18 are formed by a 45 degree arc with a 15 inch radius that is drawn about a center point. These center points are located along a cross line that crosses the centerline D, normal thereto, approximately 8 inches from end 62. The center points for each arc lie 7 inches along the cross line from either side of the centerline D. This is but a preferred configuration for a 60 durometer neoprene elastomeric biasing means that has generally linear resistance characteristics and various other curvatures will create the changing moment arm necessary to oppose the increasing tension created within other biasing means.

In the preferred embodiment, the bases 16, the member 18, and the bar 20 are comprised of a generally rigid synthetic resin. However, these parts may be made out of metal or any other suitable material. The strap 24 is comprised of a cloth reinforced neoprene; however, nylon or other suitable materials may be used. The biasing means 22 is comprised of an elastomeric band in the preferred embodiment; however, the band may be made from other elastic materials suitable for the purpose. The biasing means 22 may also be comprised of springs or other suitable constructions suitable for the purpose of providing resistance. The biasing means is constructed of a band of elastomeric material that has a resistance of a predetermined number of pound inches based on the amount of resistance required by the individual using the exercise device 10. That is, the device being used by someone just beginning a training program may have a biasing means having 50 pound inches of resistance while a person who has been training for some time may be able to use a biasing means having 200 pound inches.

Having thus set forth a preferred construction for the exercise device 10 of this invention, it is to be remembered that this is but a preferred embodiment. Attention is now invited to a description of the use of the exercise device 10.

The exerciser 14 should select a strong door 12 with a clear area around it to provide sufficient room for storage of the device while mounted on the door 12 and to provide sufficient room to complete the exercises. The exerciser having selected an exercise that requires downward movement mounts the base 16 having the biasing means 22 and the member 18 mounted thereon, to the top edge 38 of the door 12. The other base 16 is slid under the bottom edge 40 of the door 12 and aligned generally below the base 16 attached to the upper edge 38 of the door 12. The biasing means 22 is stretched so that the clip 88 may be attached to one of the holes 82 in the second part 78 of the bar 20. As the biasing means 22 is under tension, it will pull upwardly on the arm 30 and, thus, upwardly on the base 16 holding each base 16 snugly against the door 12. As seen in FIG. 7, the exerciser 14 then attaches a grip 98 to the clip 88 at the end 86 of strap 24. The grip 98 may comprise a shaft, as illustrated, a pair of handles or any number of appropriate attachments necessary for a particular exercise. The exerciser 14 then pulls downwardly on the strap 24 causing the first end 76 of the bar 20 to pivot upwardly rotating about the bolt 72 so that the biasing means 22 is stretched creating a resistance force. As the second end 86 of the strap 24 moves downwardly, the member 18 rotates increasing the moment arm 96 and reducing the work effort needed by the exerciser to reach full contraction of the exercised muscles. By reducing the effort required, the exerciser is able to make a thoroughly complete contraction, even though the muscle strength at the flexion position of full contraction is weaker than when the muscles are at a mid-range position of flexion. Different exercises of different muscle groups require a different amount of resistance; therefore, as illustrated in FIG. 4, the exerciser may attach the clip 88, that is attached to the end 84 of strap 24, to any one of the holes 82 in the first part 74 of the bar 20. By attaching the strap 24 in positions closer to the pivot point A, the leverage gained by the bar 22 is reduced increasing the force necessary to extend first end 86 of the strap 24. By attaching the clip 88, that is attached to the second end 90 of the biasing means 22, in holes closer to the pivot point A, the leverage benefit provided to the exerciser 14 is increased and the force necessary to extend the second end 86 of the strap 24 is reduced. Therefore, by selectively attaching the second end 84 of the strap 24 to different holes 82 and by selectively adjusting the point of attachment for the second end 90 of the biasing means 22, a great number of different resistances may be obtained. In addition, as mentioned before, different biasing means 22 may be substituted that have different ratings of resistance in pounds per inch.

To use the exercise device 10 so that an upward pull is obtained, all that is, necessary is to reverse the positions of the bases 16 on the door 12 so that the base 16 with the member 18 attached is now attached to the bottom edge 40 of the door 12.

It will, thus, be seen that the objects set forth above among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described. All statements of the scope of the invention which, as a matter of language, might be said to fall there between. Now that the invention has been describes,

What is claimed is:

1. A portable exercise device comprising:

a pair of bases spaced apart from one another, each base being configured for attachment to a support means;

a member having a peripheral edge, said member being pivotally attached to one of said pair of bases;

a bar having a first end and a second end, said bar being pivotally attached, at a pivot point intermediate said first and second ends of said bar, to the other one of said pair of bases, said pivot point defining a first part of said bar extending from said pivot point to and including said first end of said bar and a second part of said bar extending from said pivot point and including said second end of said bar;

a longitudinally extending biasing means having first and second ends, said first end being connected to said base to which said member is attached thereto and said second end of said biasing means being attached to said second part of said bar; and a strap having a first end and a second end, said first end of said strap being attached to said first part of said bar and a portion of said strap, intermediate said first and second ends thereof, engaging a portion of said peripheral edge of said member and said second end of said strap extending free from said member.

2. A portable exercise device as in claim 1 wherein said member extends generally longitudinally having a first end and a second end, said member being pivotally attached, proximal to said first end of said member, to said one of said pair of bases, said portion of said peripheral edge that is engaged by said strap curving away from a line extending between said first and second ends of said member.

3. A portable exercise device as in claim 2 wherein said peripheral edge of said member defines an ovoid shape on a plane passing through said peripheral edge of said member.

4. A portable exercise device as in claim 3 wherein said ovoid shape of said member defines a larger end generally opposing a smaller end and said larger end is said first end of said member.

5. A portable exercise device as in claim 1 wherein said bar comprises a plurality of attaching means spaced apart from one another, said first end of said biasing means being selectively attachable to one of said plurality of attaching means and said first end of said strap being selectively attachable to another one of said plurality of attaching means.

6. A portable exercise device as in claim 1 wherein said biasing means comprises an elastomeric band.

7. A portable exercise device as in claim 1 wherein each said base, of said pair of bases, comprises a plate, said plate having a first edge; an arm attached to said plate so that said arm extends outwardly therefrom, said member being pivotally attached to said arm of one of said pair of bases and said bar being pivotally attached to said arm of said other one of said pair of bases; and an L shaped extension attached to said first edge of said plate so that said extension opposes and extends generally parallel to said plate forming a U-shape with said plate that is sized to receive a support means therein, said support means comprising a door edge, whereby one said base may be attached to the top edge of a door and said other base may be attached to the bottom edge of the door.

* * * * *